United States Patent [19]

DeMaesschalck et al.

[11] 4,225,836

[45] Sep. 30, 1980

[54] MAGNETIC RELAY

[75] Inventors: Etienne DeMaesschalck, Herderen; Evrard Geelen, Tongeren, both of Belgium

[73] Assignee: C.P. Clare International, N.V., Tongeren, Belgium

[21] Appl. No.: 934,805

[22] Filed: Aug. 18, 1978

Related U.S. Application Data

[63] Continuation-in-part of Ser. No. 790,967, Apr. 26, 1977, abandoned.

[51] Int. Cl.[2] ..... H01H 11/00; H01H 1/66; H01H 51/00

[52] U.S. Cl. ..... 335/153; 29/622; 335/154

[58] Field of Search ..... 35/151, 153, 154; 29/622

[56] References Cited

U.S. PATENT DOCUMENTS

| | | | |
|---|---|---|---|
| 3,284,741 | 11/1966 | Conklin | 335/154 |
| 3,434,080 | 3/1969 | Mengelberg | 335/154 |
| 3,522,566 | 8/1970 | Van Horn | 335/154 UX |
| 3,711,798 | 1/1973 | Richert | 335/153 |
| 3,987,383 | 10/1976 | Antonitsch | 335/154 X |

*Primary Examiner*—Fred L. Braun

*Attorney, Agent, or Firm*—Brooks, Haidt, Haffner & Delahunty

[57] ABSTRACT

A magnetic relay having an electromagnetic coil with an open center extending lengthwise therethrough and an outer tube of magnetic material enclosing it lengthwise. A pair of radially expandable disks of magnetic material are positioned in the outer tube across the ends of the coil and a pair of inner tubes of magnetic material are positioned axially aligned with each other through the central openings in the disks and in the open center of the coil about a switch contact, e.g. a reed switch capsule. The adjacent ends of the inner tubes are spaced apart to form a gap adjacent the coacting ends of the switch contact. These inner tubes are of a size in the open center of the coil to pass freely through the central openings in the disks and of a larger size at the location of the disks such that these inner tubes urge the disks to expand radially into tight contact with the inside of the outer tube.

6 Claims, 6 Drawing Figures

MAGNETIC RELAY

This application is a continuation-in-part application of U.S. Ser. No. 790,967, filed Apr. 26, 1977, now abandoned.

FIELD OF THE INVENTION

The invention relates to an improved structure for an electromagnetic relay, the energizing coil of which is surrounded by a metal envelope.

In a known embodiment as disclosed in U.S. Pat. No. 3,434,080 an electromagnetic relay has metal foils wrapped underneath the energizing coil about a sealed reed switch capsule and above the energizing coil. However, this and the other known types of relays are not satisfactory to provide a high sensitivity enough for small size constructions to be used with a low-power energization for being compatible with MOS transistor technology. In these applications the power involved may not exceed a level in the order of about 10 mW and experiments have shown that the known structures for relays do not permit to obtain a suitable high sensitivity with an energization power lower than about 10 mW.

SUMMARY OF THE INVENTION

It is an object of the invention to improve the sensitivity of electromagnetic relays with a lower power energization for making them compatible with MOS technology.

Another object of the invention is a high-sensitivity small-size electromagnetic reed relay which can be easily and reliably assembled by mass production.

In accordance with the invention there is provided a magnetic relay having an electromagnetic coil with an open center extending lengthwise therethrough and switch contact means having coacting ends disposed lengthwise in said open center of said coil. An outer tube of magnetic material is positioned to enclose the coil lengthwise. A pair of radially expandable disks of magnetic material are positioned in the outer tube across the ends of the coil, each disk having a central opening aligned with the open center of the coil. A pair of inner tubes of magnetic material are positioned axially aligned with each other through the central openings in said disks and in the open center of the coil about the switch contact means with the adjacent ends of said inner tubes spaced apart to form a gap adjacent the coacting ends of the switch contact means, said inner tubes being of a size in the open center of the coil to pass freely through the central openings in the disks and of a larger size at the location of the disks whereby the inner tubes urge the disks to expand radially into tight contact with the inside of the outer tube.

DESCRIPTION OF AN EXEMPLARY EMBODIMENT

Figure 1:
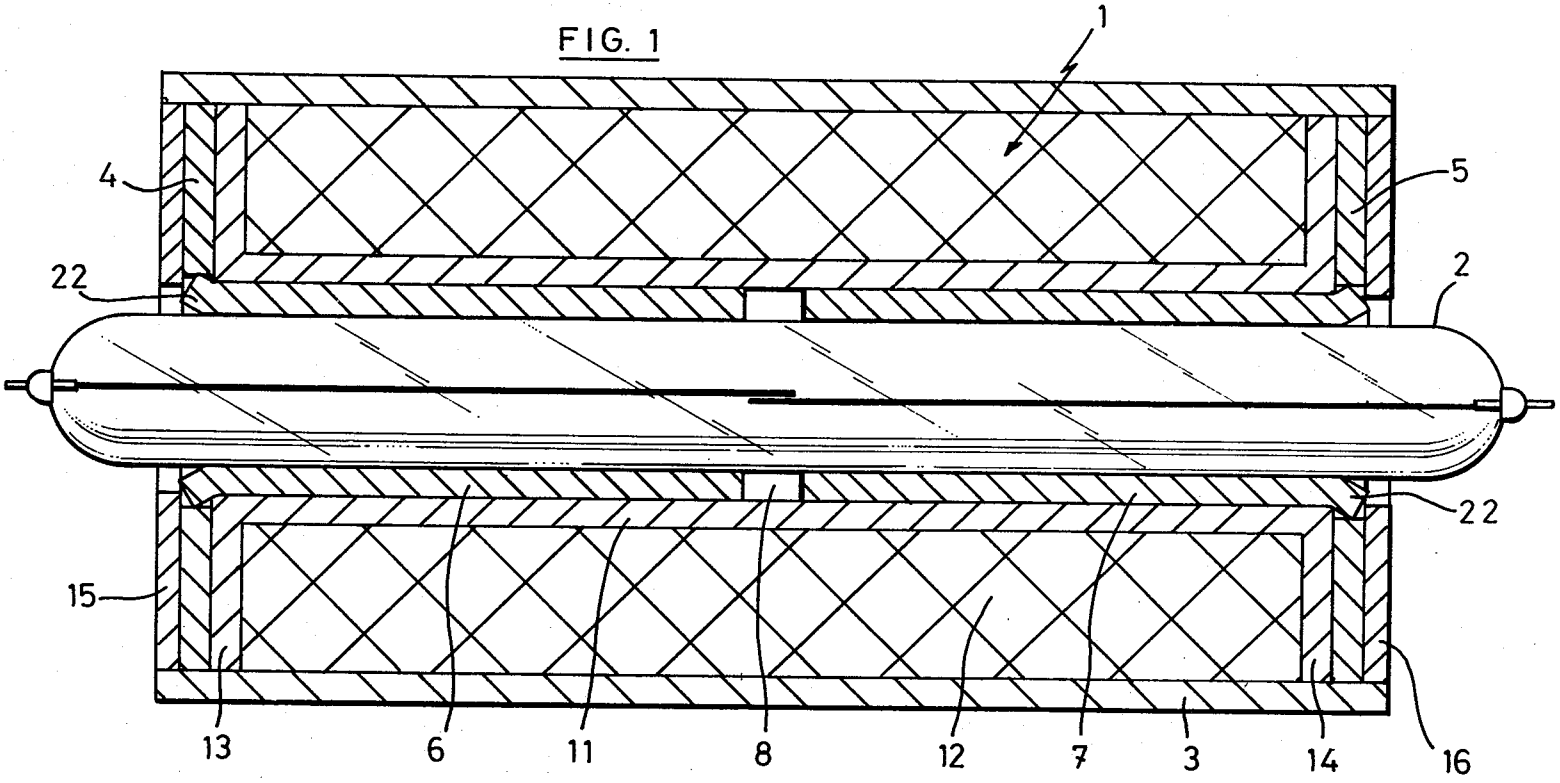
FIG. 1 is a longitudinal sectional view of the assembly in accordance with an embodiment of the invention as applied to a reed relay.

In Fig. 1 there is shown the structure of the invention as applied to an electromagnetic reed relay, that is an electromagnetic relay with reed switch contacts. An energizing coil 1 for producing the excitation magnetic field has an axial open center in which a reed switch capsule 2, known per se, is located lengthwise. An outer tube 3 of a magnetic material extends lengthwise about the coil. A pair of disks of magnetic material 4,5 are positioned in the outer tube 3 across the ends of coil 1. Each disk has a central opening which is aligned with the open center of coil 1. The disks 4 and 5 are made to be radially expandable.

Figure 2:
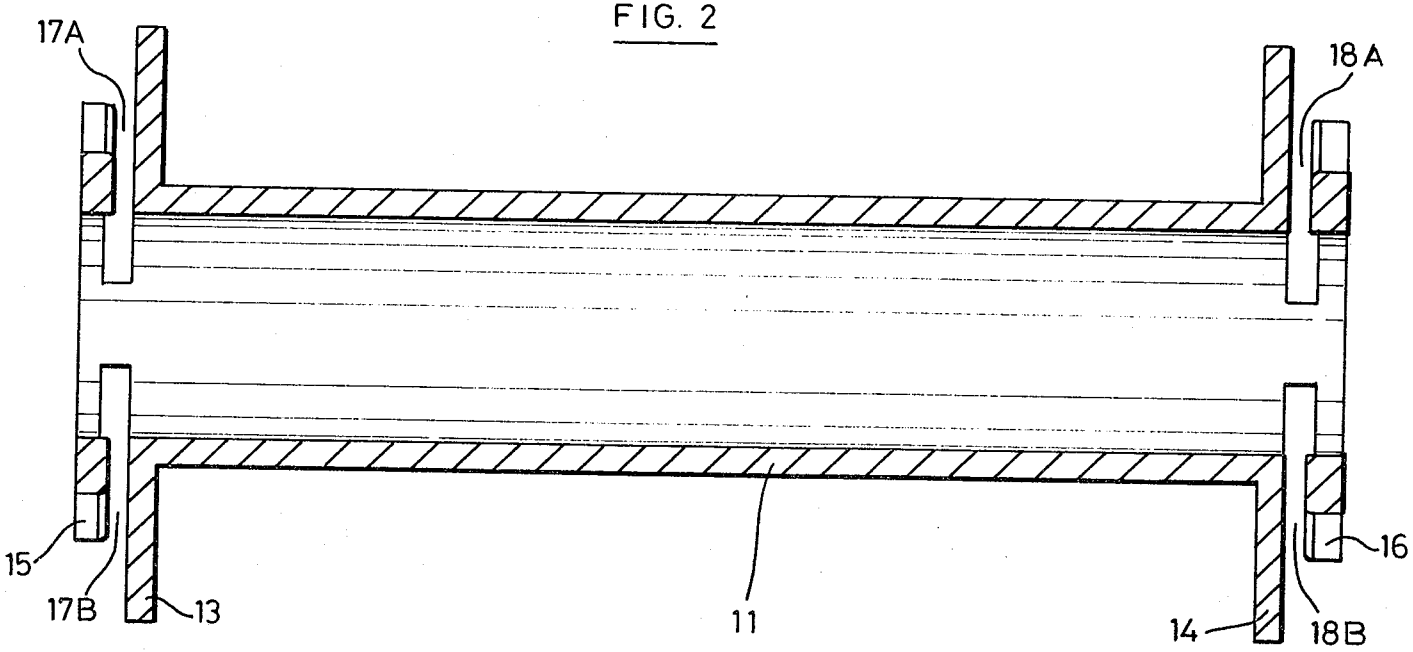
FIG. 2 is a longitudinal sectional view of an exemplary bobbin for the coil.

In the exemplary embodiment illustrated in FIG. 1 the coil 1 comprises a bobbin 11 for supporting the excitation winding 12, the bobbin 11 having a pair of flanges 13, 14. As more readily apparent from FIG. 2, the bobbin 11 is provided with a second pair of flanges 15,16 each defining a pair of coplanar circular segmental slots 17A,17B and 18A, 18B with the corresponding one of flanges 13 and 14. Each of said slots has a depth intercepting the open center of bobbin 11.

Figure 3:
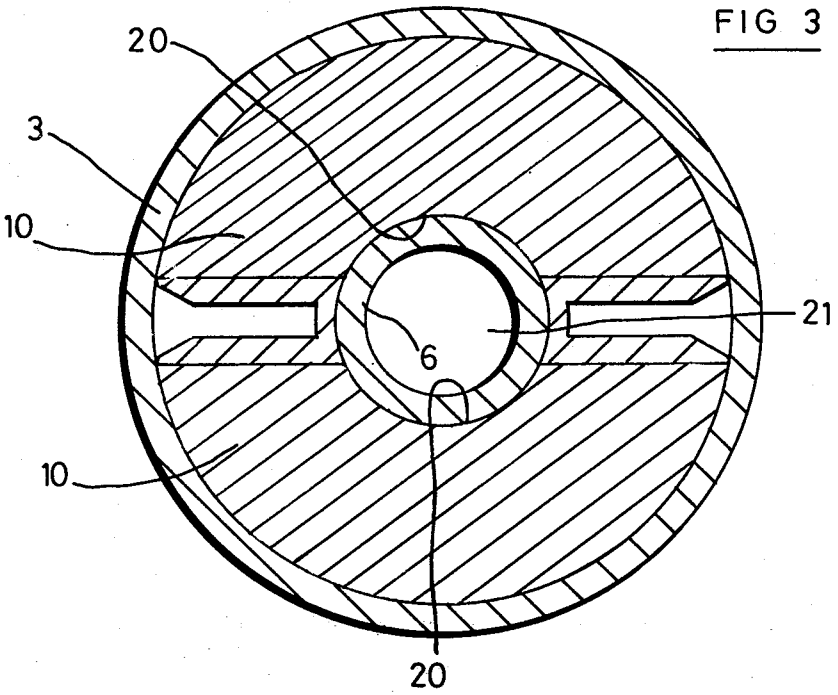
FIG. 3 is a cross-sectional view along line III—III in FIG. 1, with reed capsule removed.

Each disk is comprised of a pair of coplanar plates 10 each generally in the form of a circular segment as shown in FIG. 3. The pair of coplanar plates 10 are disposed symmetrically with respect to each other and with the chordal portions thereof confronting. Each chordal portion has a recess or opening 20 in the center thereof such that when a pair of coplanar plates 10 are symmetrically positioned, the two recesses 20 are confronting thereby to form a central opening 21.

A pair of inner tubes 6, 7 of magnetic material are positioned axially aligned with each other through the central openings 21 and in the open center of coil 1 about the switch contact capsule 2. The adjacent ends of the inner tubes 6, 7 are spaced apart to form a gap 8 adjacent the coacting ends of the switch contacts in capsule 2. The tubes 6 and 7 have advantageously a size in the open center of coil 1 to pass freely through the central openings 21 and a larger size at the location of the disks 4 and 5. This larger size at the location of the disks is advantageously in the form of an outward flare 22. When in position these flared ends of the inner tubes 6 and 7 urge the disks 4 and 5 radially into tight contact with the inside of the outer tube 3, thereby assuring a magnetic path having minimum reluctance.

Figure 4:
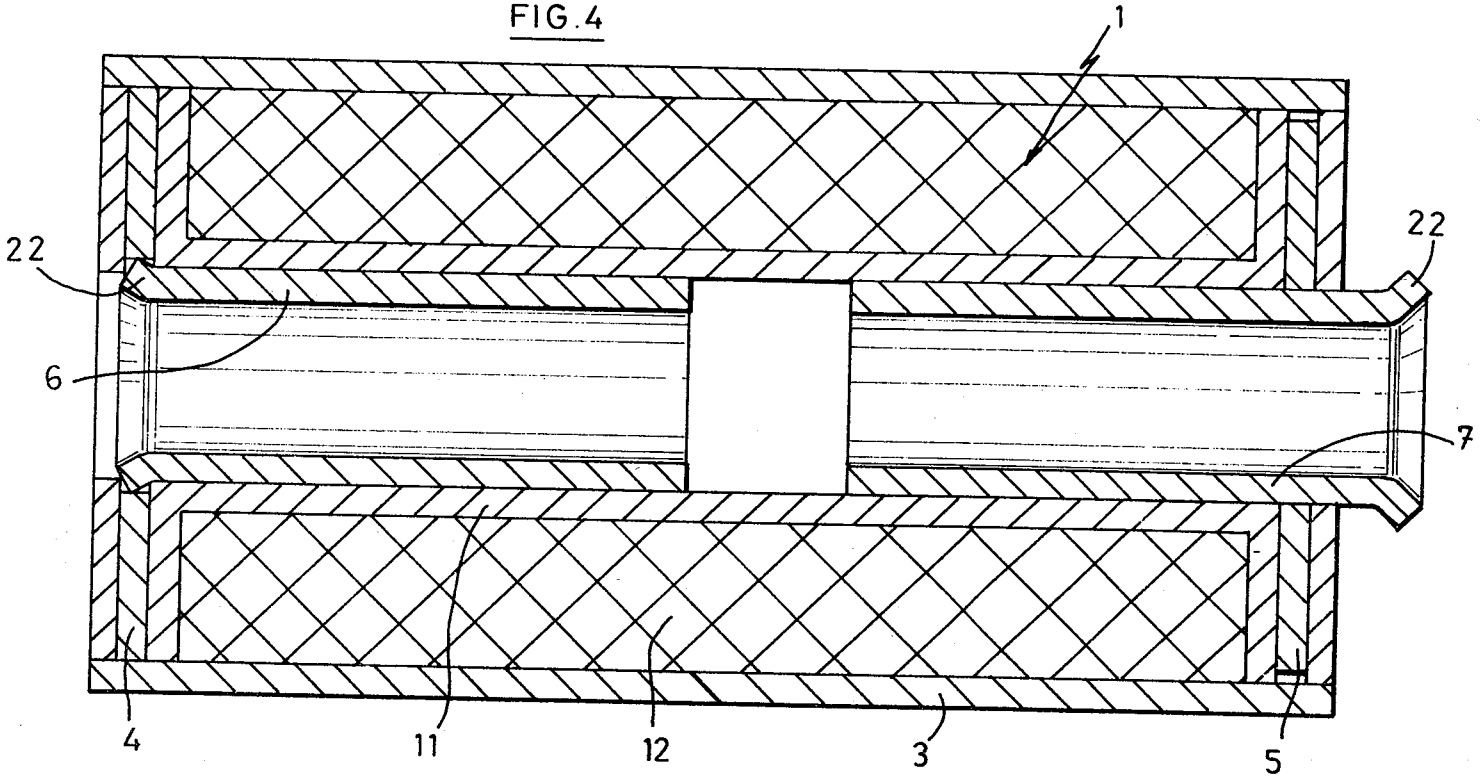
FIG. 4 is a schematic view showing the method of positioning the inner tubes into the coil.

The inner tubes 6 and 7 are advantageously inserted into position by the following method in accordance with a further aspect of the invention. Reference will be made to FIG. 4 which shows one flared tube 7 prior to being positioned in the assembly. As apparent from this drawing, the inner tubes have an outward flare 22 the outer diameter of which is greater than the diameter of the central openings 21 in disks 4 and 5. For example, with inner tubes having an external diameter of 3.6 mm, the outer diameter at the flared ends is typically about 4 mm. To be positioned in the open center of coil 1 the flared tube 7 is forced axially through the central opening 21 into the open center of the coil 1 until its outer end is received in the central opening 21 into cooperation with the chordal portions of the pair of plates 10, whereby said plates are urged to expand radially into tight contact with the inside of outer tube 3.

Experiments have shown that the structures according to the invention permits to achieve a relay having a higher sensitivity than prior art relays.

Comparative tests have been made on several small-size samples A built with straight inner tubes in accordance with the prior art and on several samples B built with outwardly flared tubes in accordance with the teaching of the invention.

The constructional particulars of the samples are the following:

Switch Capsule Clare Picoreed Switch 102287
diameter: 2.54 mm
length: 26.4 mm
Inner tubes
internal diameter: 2.54 mm
external diameter: 3.6 mm
length: 9.6 mm
Outer tube
internal diameter: 9.6 mm
external diameter: 10.4 mm
length: 20.3 mm
Flanges
opening diameter: 3.65 mm For the samples B, the inner tubes have been flared at one end such that the outer diameter at the flared end is about 4 mm.

The test results obtained with the two groups of samples are given in the table below indicating the ratio $\rho$ of the operate ampere-turns of the used capsules to the operate ampere-turns in the applicant's testcoil:

| Samples | A | B |
|---|---|---|
| 1 | 0.65 | 0.56 |
| 2 | 0.73 | 0.56 |
| 3 | 0.72 | 0.57 |
| 4 | 0.70 | 0.54 |
| 5 | 0.70 | 0.57 |

The values in the table above clearly show that the construction in accordance with the invention (column B) requires substantially less magnetizing energization for operating the reed contacts than the prior art construction (column A).

Figure 5:
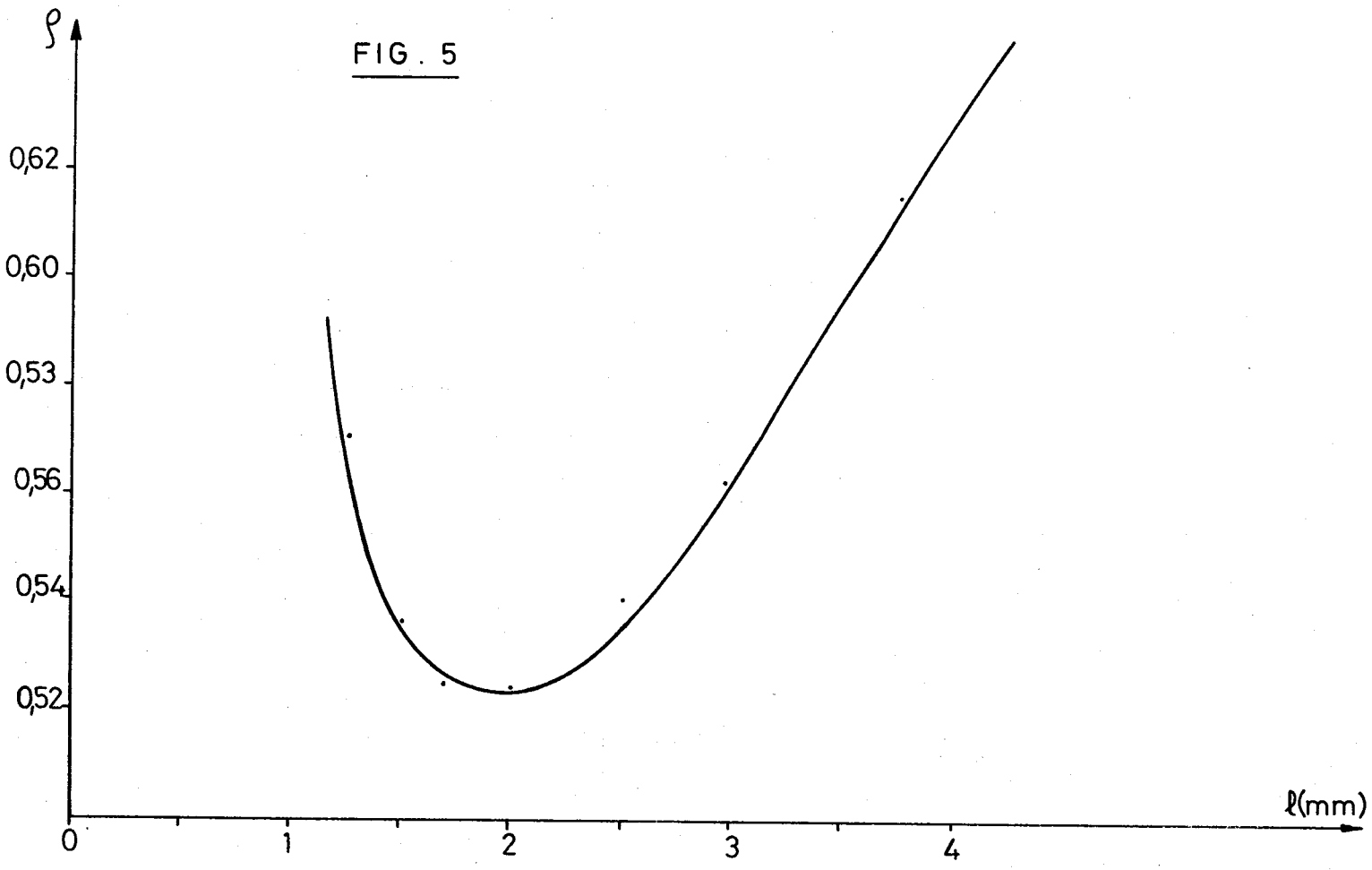
FIG. 5 is a graph illustrating the optimization of the sensitivity of the switch contact means.

It has further been found that an optimization of the sensitivity can be obtained in the structure according to the invention by choosing for the annular gap between the inner tubes 6 and 7 a length l such that the ratio of this length to the diameter d of the tubes is comprised in the range extending from 0.45 to 0.85. The graph of FIG. 5 is a curve showing the influence of the gap length l on the ratio $\rho$ for tubes having a diameter d of about 2.54 mm. It can be seen that the optimum gap is about 2 mm in the structure in accordance with the invention.

It is also possible to implement a relay in accordance with the invention by using one flared inner tube only. With such an embodiment the improvement in sensitivity is of course lower than with the embodiment of FIG. 1 but an improved sensitivity is nevertheless obtained as against the prior art.

Figure 6:
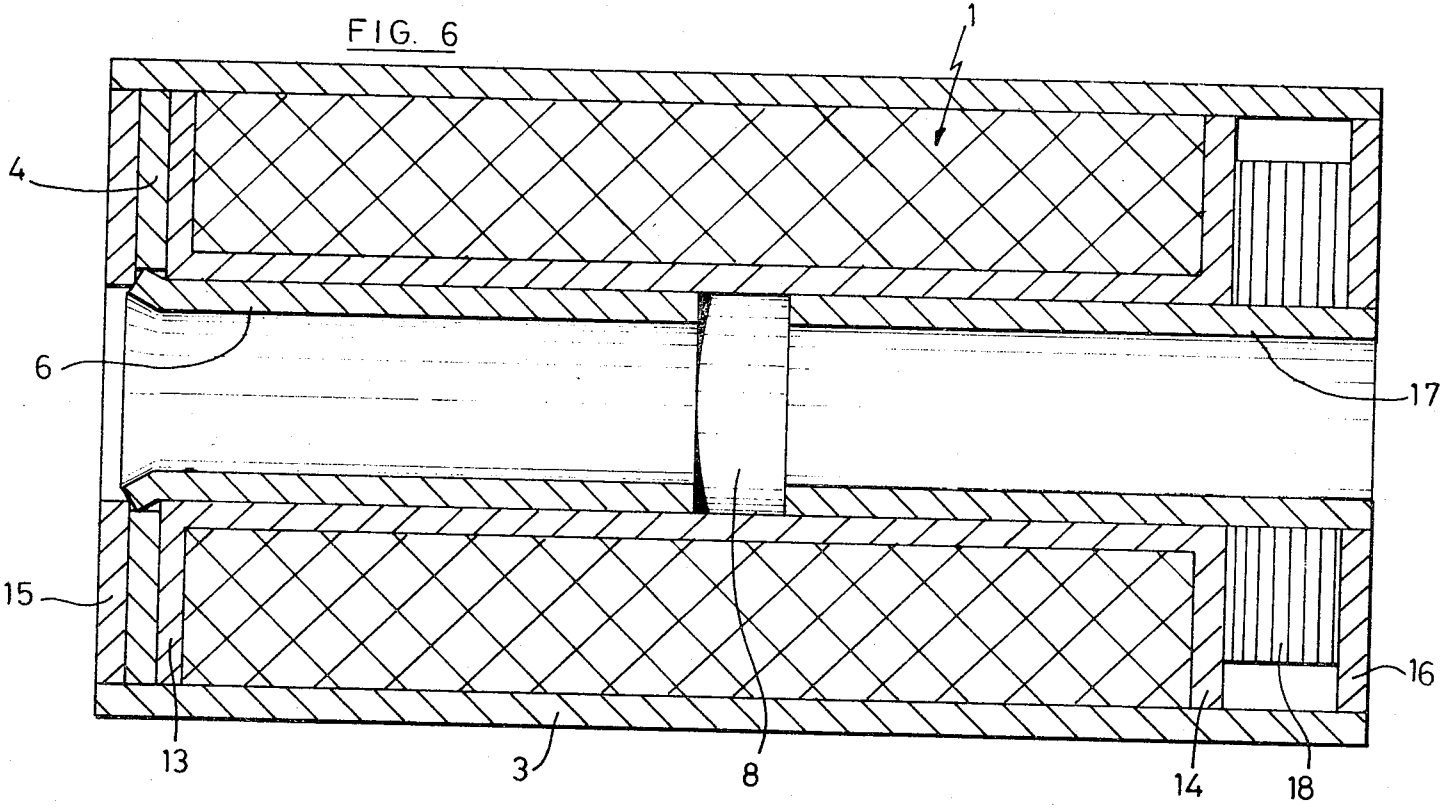
FIG. 6 depicts a variation of the assembly of FIG. 1, with reed capsule removed.

The embodiment of FIG. 6 is similar to that of FIG. 1 with respect to the left hand portion thereof. The only difference is that the right hand disk in FIG. 1 is replaced by a permanent magnet 18 located between flanges 14 and 16, said permanent magnet being magnetized such as to produce a radial magnetic flux shorting the outer tube 3 and the inner tube 17. The latter need not to have an outwardly flared end, though this is quite feasible. This embodiment permits the switch contact means to be kept closed during the time that the coil is not energized. A variation is providing the permanent magnets embedded in a non-magnetic material, e.g. a plastic material. Also the disk may be replaced by several permanent magnets placed symmetrically about the open center of coil 1.

What is claimed is:

1. In a magnetic relay having an electromagnetic coil with an open center extending lengthwise therethrough and switch contact means having coacting ends disposed lengthwise in said open center of said coil, the improvement which comprises:

an outer tube of magnetic material enclosing said coil lengthwise;

a pair of radially expandable disks of magnetic material positioned in said outer tube, across each end of the coil, each disk having a central opening aligned with said open center of the coil; and a pair of inner tubes of magnetic material positioned axially aligned with each other through said central openings in said disks and in said open center of said coil about said switch contact means with the adjacent ends of said inner tubes spaced apart to form a gap adjacent said coacting ends of said switch contact means, said inner tubes being of a size in said open center of said coil to pass freely through said central openings in said disks and of a larger size at the location of said disks whereby said inner tubes urge said disks to expand radially into tight contact with the inside of said outer tube.

2. The improvement according to claim 1 in which each said inner tube terminates at the outer end thereof at the location of one of said disks and in which said larger size at the location of said central opening of said disk is in the form of an outward flare at said outer end of said inner tube.

3. The improvement according to claim 2 in which each said disk comprises a pair of plates, each generally in the form of a circular segment, said plates being coplanar and disposed symmetrically with respect to each other and with the chordal portions thereof confronting whereby said central opening is in the form of a pair of confronting openings, one in each said plate at the center of the chordal portion thereof.

4. The improvement according to claim 3 which further includes a bobbin of non-magnetic material having flanged ends and an open center, said electromagnetic coil being positioned on said bobbin with said switch contact means and said inner tubes being positioned in the open center of said bobbin, and means defining a pair of coplanar circular segmental slots in each flanged end of said bobbin, said slots having a depth intercepting the open center of the bobbin, said plates forming the said disks being positioned in said segmental slots in the flanges of said bobbin.

5. The improvement according to any one of claims 1, 2, 3 or 4 in which said gap between the adjacent ends of said inner tubes has a predetermined axial length such that the ratio of said axial length to the diameter of the inner tubes is comprised in the range extending from about 0.45 to about 0.85 thereby to maximize the sensitivity of said switch contact means.

6. A method of assembling a magnetic housing for a magnetic relay having an electromagnetic coil with an open center extending lengthwise therethrough and switch contact means having coacting ends disposed lengthwise in said open center of said coil which comprises positioning an outer tube of magnetic material to enclose said coil lengthwise, positioning a radially expandable disk of magnetic material in said outer tube across each end of said coil, each disk having a central opening which is aligned with the open center of the coil, and inserting a pair of inner tubes of magnetic material, one at each end of said open center of said coil, with said tubes axially aligned with each other through said central openings of said disks, said inner tubes being sized along the length thereof to pass through said central openings and the outer ends thereof being enlarged whereby, as said inner tubes are positioned with their inner ends adjacent each other forming a gap therebetween and the outer ends of said inner tubes are received in said central openings, said outer ends urge said disks to expand radially into tight contact with the inside of said outer tube.

* * * * *